US005841083A

United States Patent [19]

Schönauer et al.

[11] Patent Number: 5,841,083

[45] Date of Patent: Nov. 24, 1998

[54] BLOCKED DOOR DETECTION FOR AN ELEVATOR SYSTEM

[75] Inventors: Uwe Schönauer, Berlin, Germany; Helmut L. Schröder-Brumloop, Ville d'Avray, France

[73] Assignee: Otis Elevator Company, Farmington, Conn.

[21] Appl. No.: 769,015

[22] Filed: Dec. 18, 1996

[51] Int. Cl.[6] ..... B66B 13/14

[52] U.S. Cl. ..... 187/316; 49/26

[58] Field of Search ..... 187/316, 317; 49/26, 409

[56] References Cited

U.S. PATENT DOCUMENTS

| | | | |
|---|---|---|---|
| 3,814,214 | 6/1974 | Booker, Jr. | 187/316 |
| 4,505,360 | 3/1985 | Tsuji | 187/316 |
| 4,750,591 | 6/1988 | Coste et al. | 187/391 |

*Primary Examiner*—Robert Nappi

[57] ABSTRACT

A method for detecting if an elevator door is blocked comprises the steps of: initiating a movement of the elevator door; starting a timer count upon the initiation of the movement of the door; determining if the timer count has expired before a door position reference switch is actuated; and determining that the elevator door is blocked if the timer count has expired before the door position reference switch is actuated.

8 Claims, 3 Drawing Sheets

BLOCKED DOOR DETECTION FOR AN ELEVATOR SYSTEM

TECHNICAL FIELD

The present invention relates generally to elevators and, in particular, relates to the detection of blocked doors in an elevator system.

BACKGROUND OF THE INVENTION

In elevator systems it is common to use one or more automatic sliding doors. Detection systems are used to detect the presence of obstructions in the path of the doors before and during closure for the protection of the passengers. Typically the systems, in the event of an obstruction, prevent the elevator doors from closing further and, preferably, reopen them.

One known system for detecting objects in the path of an elevator door places a light beam in a path across the door opening and uses a sensor to detect an interruption of the light beam, which would occur if an obstruction is in the door's path. Upon sensing the interruption, the sensor issues a signal to alter the control of the door operation, and preferably reopens the door. However, this type of system only detects obstructions in the path of the door and does not detect door blockage caused by other means, such as a faulty door track or motor. Additionally, a light beam detection device adds complexity and cost to a door system.

Another known system for detecting door obstructions includes an incremental encoder for providing speed or position feedback. The encoder operates by having a rotatable encoder shaft connected to a door motor shaft so as to rotate conjointly therewith. The number, direction, and speed of encoder shaft rotations thus indicate the direction of movement, speed and position of the elevator door. Thus, the encoder provides the capability to detect deviations in the door's motion. The encoder, however, introduces added expense and complexity into the door system and must be configured to cooperate with a large number of different motor designs. Thus, the cost of modernizing a large variety of door systems is high.

Another known system for detecting door obstructions includes a current sensor to detect an increase in a load of a door motor. This detection system determines that an obstruction exists if a current of the door motor increases. However, variations in a mechanical load, such as the weight of the landing doors in the elevator system, influence the performance of this type of detection system. The weight of the landing doors can vary significantly from landing to landing. The motor current is adjusted to provide compensation for the varying weight such that a desired speed profile is achieved. For example, a relatively heavy door requires an increased motor current. The increased current, however, can be falsely interpreted by the detection system as an obstruction. Additionally, costs associated with the sensor and its associated components, such as means to transmit information from a high voltage point to a low voltage point, are relatively high.

DISCLOSURE OF THE INVENTION

It is an object of the present invention to provide a method for detecting if a door is blocked in an elevator door system.

According to the present invention, a method for detecting if an elevator door is blocked comprises the steps of: initiating a movement of the elevator door; starting a timer count upon the initiation of the movement of the door; determining if the timer count has expired before a door position reference switch is actuated; and determining that the elevator door is blocked if the timer count has expired before the door position reference switch is actuated.

The present invention includes the advantage of providing door blockage detection without the complexity or costs associated with the prior art. Additionally, the present invention includes the ability to detect the blocked elevator door regardless of the cause of the blockage. Moreover, the present invention detects the blocked door during door closing operations as well as during door opening operations; thus allowing the elevator door system to take appropriate action in either case.

BEST MODE FOR CARRYING OUT THE INVENTION

Figure 1:
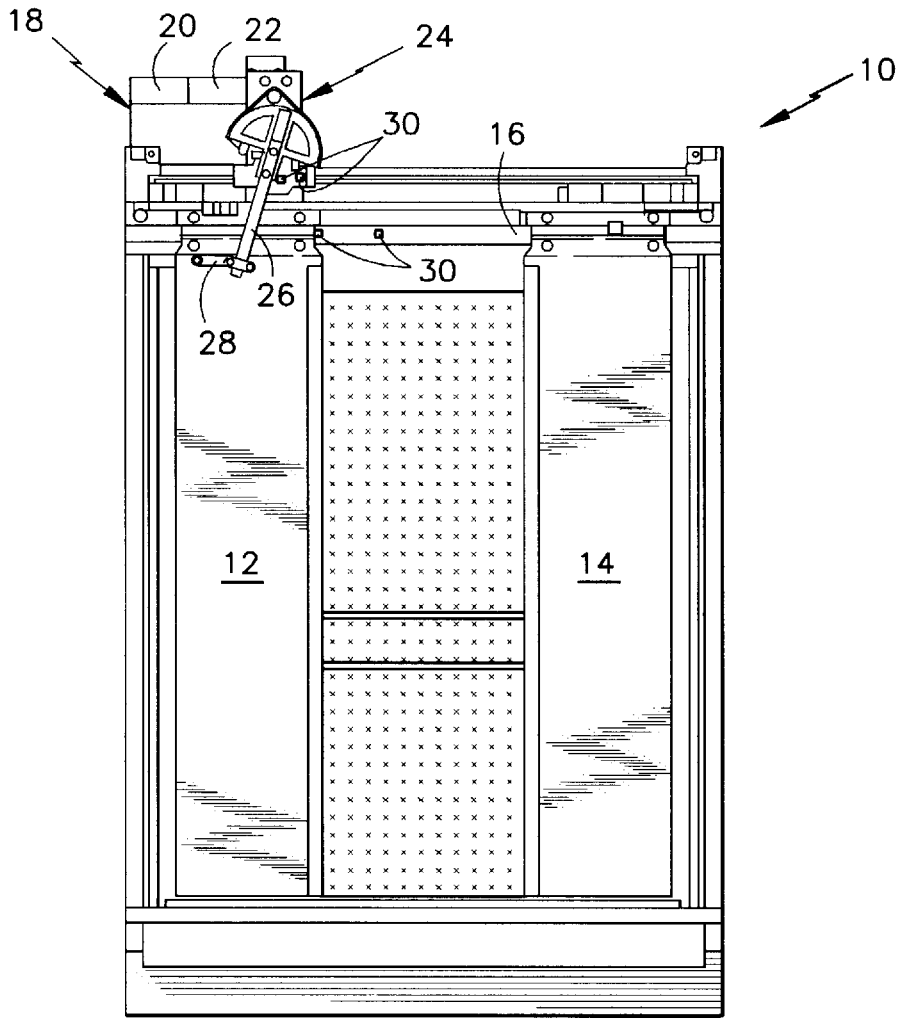
FIG. 1 is a front view of a center opening elevator door system.

Referring to FIG. 1, an example of a center opening elevator door system 10 is shown. Elevator doors 12, 14 are slidably disposed on a door track 16 such that the doors 12, 14 ride along the track 16 between an open and a close position. The door system 10 includes a door controller 18 having a memory 20 and a processor 22 for storing and executing various programs for controlling the doors 12, 14. A motorized door unit ("door operator") 24 is operatively connected to a first door 12 via a pivot arm 26 and a link assembly 28 in order to automatically open and close the doors 12, 14 in response to a command signal provided by the door controller 18. A second door 14 is mechanically linked to the first door 12 such that movement of the first door 12 causes the second door 14 to move in a synchronized manner. In one embodiment, a mechanical linkage for linking the doors includes a roped pulley system, the implementation of which is well known to those skilled in the art.

One of ordinary skill in the art would recognize, in light of the instant specification, that the present invention can be used in conjunction with other elevator door systems including, but not limited to, single slide side-opening doors systems, telescopic door systems and linear motor door systems. Additionally, for purposes of this specification, a door is blocked if its movement is stopped, obstructed or impeded as the door controller attempts to move the door.

At least one position reference switch 30 is used for providing position information to the door controller 18. The switch 30 is used, in one example, to provide an indication to the door controller 18 that the doors have reached a deceleration point at which the doors should begin their deceleration. Nevertheless, any position reference switch which provides information regarding the position of the doors may be used without departing from the spirit of scope of the present invention. In one embodiment, the door system comprises two position reference switches, the first of which for indicating a deceleration point for opening doors and the second for indicating a deceleration point for closing doors.

In one embodiment, the position reference switch 30 is disposed on the door operator 24 so as to detect the motion of the pivot arm 26 and provide position information of the doors 12, 14 as they move between the open and closed positions. In another embodiment, the position reference switch 30 is disposed proximate to the track 16 such that at least one of the doors 12, 14 actuate the switch 30 as it passes the switch during either an opening or closing operation.

Figure 2:
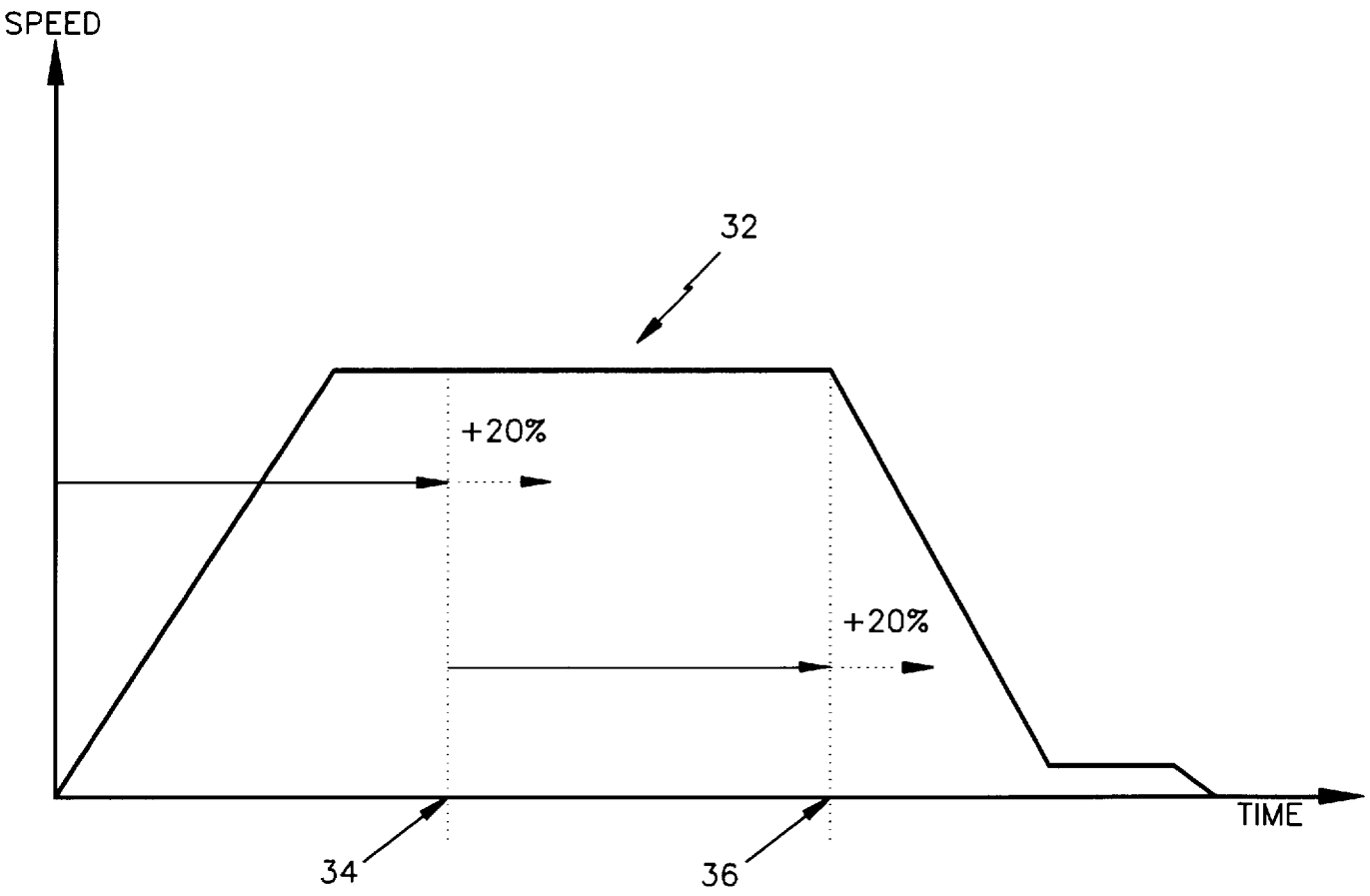
FIG. 2 is an illustration of an example of an elevator door speed profile.

Referring to FIG. 2, an example of a door speed profile 32 for a door system 10 having two position reference switches is shown. The speed profile 32 is shown is for a closing operation. A door opening position reference switch is used to indicate to the door controller 18 a door opening deceleration point 34. Accordingly, the door controller 18 begins deceleration of the doors 12, 14 at the door opening deceleration point 34 during an opening operation. A door closing position reference switch is used to indicate to the door controller 18 a door closing deceleration point 36. Accordingly, the door controller 18 begins deceleration of the doors 12, 14 at the door closing deceleration point 36 during the closing operation. Of course, the door opening deceleration switch does not affect door operation as the door is closing and, similarly, the door closing deceleration switch does not affect operation as the door is opening. However, the switches are both actuated as the door moves in either direction and consequently may be used for reference position determination in accordance with the present invention as is described below.

Prior to beginning normal operation, a calibration run is performed so that time intervals that characterize a regular, undisturbed door motion in all relevant modes of operation are measured and stored in memory. For example, a time interval between an initiation of a door operation and the deceleration points are measured and stored in the memory. Additionally, a second time interval between the two deceleration points may be measured and stored in memory. These time intervals vary according to the design of the door system and the present invention is not restricted to a particular value or range of values of the time intervals.

In addition, in one embodiment, a tolerance is added to the time intervals to provide compensation for temporary variations in friction, temperature, supply voltage, or other such factors which affect door performance. In a particular embodiment, a tolerance of twenty percent of the interval is used.

Furthermore, an adaptive program that provides compensation for slow degradation in door performance is used in one embodiment of the present invention. The adaptive program automatically adjusts the time intervals in accordance with actual time intervals that are measured during normal door operation. The actual time intervals are recorded, averaged and stored by the adaptive program and the averages are used to replace previously stored values for the time intervals. Thus, false blockage detection caused by slow degradation is minimized. The adaptive program resides in memory and is run at a determined interval such as, for example, once every month.

Figure 3:
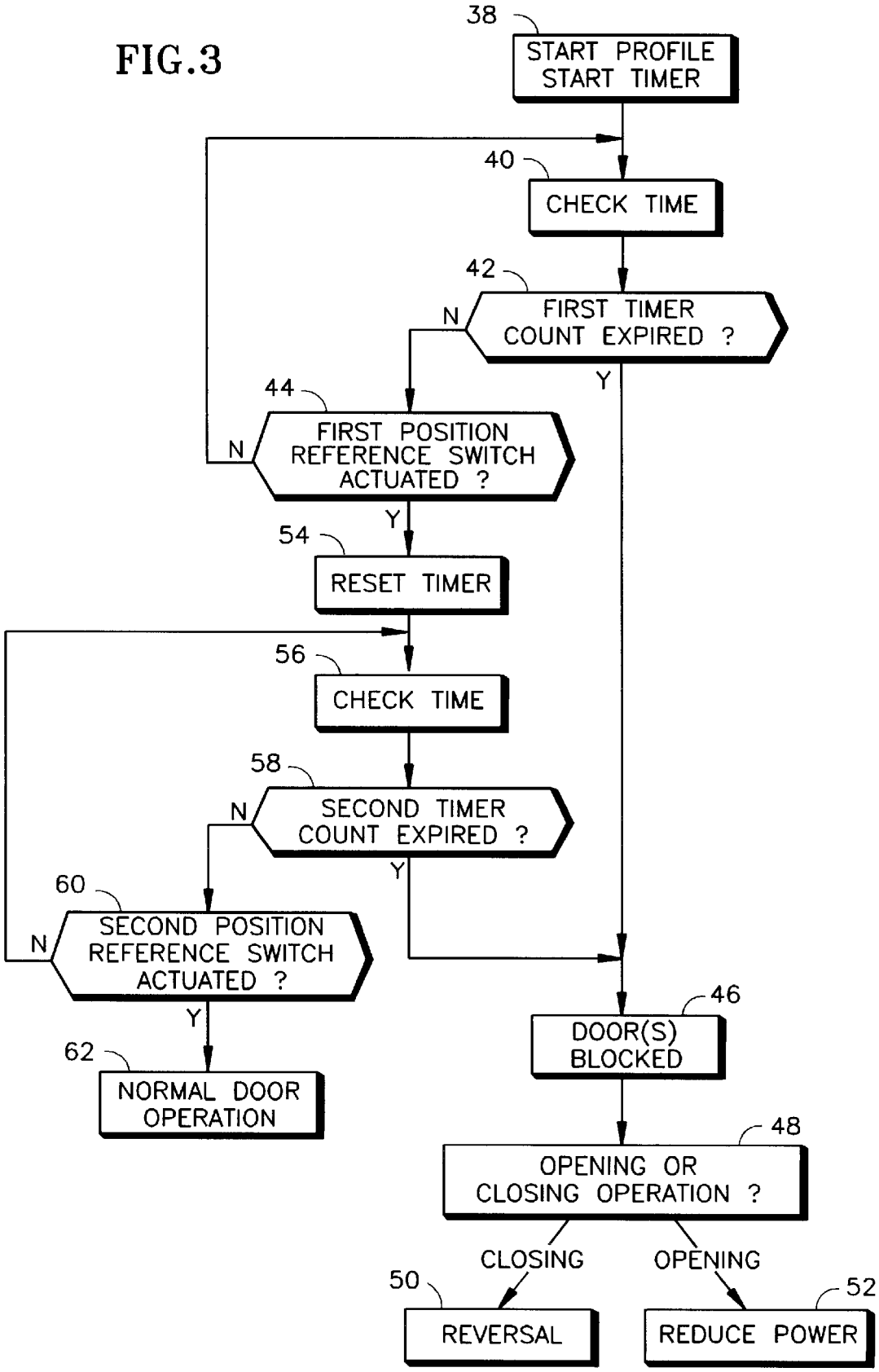
FIG. 3 is a flow chart illustrating an operation of an embodiment of the present invention.

Referring to FIG. 3, the following description illustrates an operation of one embodiment of the present invention that includes a first position reference switch and a second position reference switch; however, one position reference switch or a plurality of position reference switches may be used without departing from the spirit of scope of the present invention.

The profile and a timer are both initiated in the first step 38. Next, it is determined if a first timer count, provided by the timer, has expired in step 42. If the timer count has expired before the first position switch is actuated then the present invention determines that the elevator doors are blocked in step 46. Next, in step 48, it is determined whether the door blockage occurred during the closing operation or the opening operation. If the door system 10 was in the closing operation when the blockage occurred, a door reversal is requested by the door controller 18 in step 50. If, however, the blockage occurred during the opening operation then the door controller 18, in step 52, requests that a lower power be provided to the door operator 24 so as to minimize possible damage to the door system 10.

If the first position reference switch is actuated in step 44 before the first timer count has expired in step 42 then, in step 54, the timer is reset. Next, it is determined if a second timer count has expired before the second reference position switch is actuated. If so, then it is determined that the doors are blocked in step 46. The remaining steps after it has been determined that the doors are blocked 48, 50, 52 are implemented as described above.

If the second position reference switch is actuated in step 60 before the second timer count has expired then the door controller 18 continues normal door operation, such as starting the deceleration of the doors.

Various changes to the above description may be made without departing from the spirit and scope of the present invention as would be obvious to one of ordinary skill in the art of the present invention.

What is claimed is:

1. A method for detecting if an elevator door is blocked during opening comprising the steps of:

initiating a particular movement of the elevator door in a direction to open the door;

starting a timer count upon the initiation of the opening of the door;

determining if the timer count has expired before a door position reference switch is actuated;

determining that the elevator door is blocked if the timer count has expired before the door position reference switch is actuated; and reducing power to a door operator in response to determining that the elevator door was blocked during the opening operation.

2. A method for detecting if an elevator door is blocked comprising the steps of:

initiating a movement of the elevator door;

starting a timer count upon the initiation of the movement of the door; determining if the timer count has expired before a door position reference switch is actuated;

determining that the elevator door is blocked if the timer count has expired before the door position reference switch is actuated;

and initiating a door deceleration if the reference position switch is actuated lo before the timer count has expired.

3. A method for detecting if an elevator door is blocked comprising the steps of:

initiating a particular movement of the elevator door;

starting a first timer count upon the initiation of the movement of the door; determining if the first timer count has expired before a first door position reference switch is actuated;

determining that the elevator door is blocked if the first timer count has expired before the first door position reference switch is actuated;

determining if a second timer count has expired before a second position reference switch is actuated if the first elevator door reference position switch is actuated before the first timer count has expired; and determining that the elevator door is obstructed if the second timer count has expired before the second reference position switch is actuated.

4. The method for detecting if the elevator door is blocked as recited in claim 3 further comprising the step of determining that the elevator door was blocked during an opening operation.

5. The method for detecting if the elevator door is blocked as recited in claim 4 further comprising the step of reducing power to a door operator in response to determining that the elevator door was blocked during the opening operation.

6. The method for detecting if the elevator door is blocked as recited in claim 3 further comprising the step of determining that the elevator door was blocked during a closing operation.

7. The method for detecting if the elevator door is blocked as recited in claim 6 further comprising the step of initiating a door reversal in response to determining that the elevator door was blocked during the closing operation.

8. The method for detecting if the elevator door is blocked as recited in claim 3 further comprising the step of initiating a door deceleration if the second reference position switch is actuated before the second timer count has expired.

* * * * *